US006644360B1

(12) United States Patent
Sobota et al.

(10) Patent No.: US 6,644,360 B1
(45) Date of Patent: Nov. 11, 2003

(54) MEMBRANE AND SENSOR FOR UNDERGROUND TANK VENTING SYSTEM

(75) Inventors: Richard R. Sobota, Kernersville, NC (US); William P. Shermer, Greensboro, NC (US); Seifollah S. Nanaji, Greensboro, NC (US); Edward A. Payne, Greensboro, NC (US)

(73) Assignee: Gilbarco Inc., Greensboro, NC (US)

( * ) Notice: Subject to any disclaimer, the term of this patent is extended or adjusted under 35 U.S.C. 154(b) by 0 days.

(21) Appl. No.: 10/139,313

(22) Filed: May 6, 2002

(51) Int. Cl.[7] ..... B65B 1/04

(52) U.S. Cl. ..... 141/59; 141/45; 141/192

(58) Field of Search ..... 141/83, 94, 95, 141/192, 198, 59, 286, 301, 302, 44, 45

(56) References Cited

U.S. PATENT DOCUMENTS

| | | | | |
|---|---|---|---|---|
| 4,688,418 | A | 8/1987 | Cheung et al. | 73/29 |
| 4,977,528 | A | 12/1990 | Norris | 364/571.04 |
| 4,999,900 | A | 3/1991 | Anderson | 29/407 |
| 5,007,293 | A | 4/1991 | Jung | 73/861.04 |
| 5,040,577 | A | 8/1991 | Pope | 141/59 |
| 5,195,564 | A | 3/1993 | Spalding | 141/1 |
| 5,209,275 | A | 5/1993 | Akiba et al. | 141/83 |
| 5,245,869 | A | 9/1993 | Clarke et al. | 73/149 |
| 5,319,545 | A | 6/1994 | McGarvey et al. | 364/403 |
| 5,400,253 | A | 3/1995 | O'Connor | 364/442 |
| 5,423,457 | A | 6/1995 | Nicholas et al. | 222/62 |
| 5,464,466 | A | 11/1995 | Nanaji et al. | 95/45 |
| 5,465,606 | A | 11/1995 | Janssen et al. | 73/23.2 |
| RE35,238 | E | 5/1996 | Pope | 141/59 |
| 5,571,310 | A | 11/1996 | Nanaji | 96/4 |
| 5,611,841 | A | 3/1997 | Baker et al. | 95/50 |
| 5,626,649 | A | 5/1997 | Nanaji | 95/12 |
| 5,755,854 | A | 5/1998 | Nanaji | 95/11 |
| 5,782,275 | A | 7/1998 | Hartsell, Jr. et al. | 141/94 |
| 5,803,136 | A | 9/1998 | Hartsell, Jr. | 141/7 |
| 5,832,967 | A | 11/1998 | Andersson | 141/59 |
| 5,843,212 | A | 12/1998 | Nanaji | 96/4 |
| 5,878,790 | A | 3/1999 | Janssen | 141/59 |
| 5,913,343 | A | 6/1999 | Andersson | 141/59 |
| 5,944,067 | A | 8/1999 | Andersson | 141/59 |
| 5,985,002 | A | 11/1999 | Grantham | 95/47 |
| 5,992,395 | A | 11/1999 | Hartsell, Jr. et al. | 123/156 |
| 6,067,840 | A | 5/2000 | Chelvayohan et al. | 73/23.2 |
| 6,082,415 | A | 7/2000 | Rowland et al. | 141/59 |
| 6,102,085 | A | 8/2000 | Nanaji | 141/83 |
| 6,167,923 | B1 | 1/2001 | Hartsell, Jr. | 141/192 |
| 6,169,938 | B1 | 1/2001 | Hartsell, Jr. | 700/302 |
| 6,170,539 | B1 | 1/2001 | Pope et al. | 141/59 |
| 6,174,351 | B1 | 1/2001 | McDowell et al. | 96/4 |
| 6,244,310 | B1 | 6/2001 | Rowland et al. | 141/59 |
| 6,293,996 | B1 | 9/2001 | Grantham et al. | 95/47 |
| 6,302,165 | B1 | 10/2001 | Nanaji et al. | 141/459 |
| 6,325,112 | B1 * | 12/2001 | Nanaji | 141/4 |
| 6,336,479 | B1 | 1/2002 | Nanaji | 141/4 |
| 6,338,369 | B1 * | 1/2002 | Shermer et al. | 141/83 |
| 6,347,649 | B1 | 2/2002 | Pope et al. | 141/59 |
| 6,357,493 | B1 | 3/2002 | Shermer et al. | 141/59 |
| 6,360,789 | B2 | 3/2002 | Walker et al. | 141/95 |
| 6,386,246 | B2 | 5/2002 | Pope et al. | 141/59 |
| 6,418,983 | B1 | 7/2002 | Payne et al. | 141/59 |
| 6,460,579 | B2 | 10/2002 | Nanaji | 141/59 |
| 6,499,516 | B2 * | 12/2002 | Pope et al. | 141/59 |

FOREIGN PATENT DOCUMENTS

| | | | |
|---|---|---|---|
| JP | 20010004909 | 6/2001 | 141/59 |
| JP | 20010020493 | 9/2001 | 141/59 |

* cited by examiner

*Primary Examiner*—Steven O. Douglas
(74) *Attorney, Agent, or Firm*—Withrow & Terranova PLLC

(57) ABSTRACT

A fueling environment having a vent on an underground fuel storage tank may be improved by adding a mass flow meter in conjunction with a vapor recovery membrane in a tank vent. The mass flow meter measures an amount of vapor that passes through the vent and thus allows alarms to be generated if the vapors passing through the vent exceed a predetermined level or an efficiency of the membrane drops below a predetermined threshold. Measurements from the mass flow meter may be provided to a site controller or a remote location for further analysis.

45 Claims, 3 Drawing Sheets

MEMBRANE AND SENSOR FOR UNDERGROUND TANK VENTING SYSTEM

FIELD OF THE INVENTION

The present invention relates to an underground tank for a fueling environment, and particularly to an improvement in the venting system of such an underground tank.

BACKGROUND OF THE INVENTION

Most fueling environments contain a plurality of fuel dispensers connected to one or more underground fuel tanks from whence fuel is secured for delivery to vehicles. Many fuel dispensers are equipped with a vapor recovery system that recovers vapors expelled from the vehicle fuel tank and returns the vapor to the underground storage tank through the aid of a pump and motor.

Vapor recovery systems sometimes supply too much vacuum during the refueling operation. This causes the hydrocarbon vapors to be collected along with an excessive amount of air. Both gaseous elements are recovered and sent to the underground storage tank. This may result in overpressurization of the underground storage tank.

Most underground storage tanks also comprise a vent to atmosphere that has a relief valve. The relief valve will open at a predetermined pressure setting (typically calculated in terms of inches of water pressure), releasing pressure and allowing the captured hydrocarbon vapor to escape into the environment. Alternatively, if the vapor recovery system does not supply enough vacuum during the fueling process, the hydrocarbon vapors will escape at the nozzle-vehicle fill-pipe interface, again reducing the efficiency of the system. This may create negative pressure in the underground tank as more fuel is dispensed than vapor recovered. To combat this negative pressure, air may be drawn into the underground tank through the vent. The valve may have a negative pressure threshold below which air is not ingested.

Air ingested from the atmosphere comes into contact with the hydrocarbon vapors and liquid within the tank, and an equalization process will begin. In such a closed container, the hydrocarbon molecules that escape into the vapor state by evaporation cannot escape the container. More hydrocarbon molecules enter the vapor state above the liquid line by evaporation until the dynamic equilibrium of evaporation and condensation are met at a specific temperature. This phenomenon is called vapor growth. More vapor will be generated by volume than reduction in the volume of liquid. This causes the tank to become overpressurized, and the vent will be opened again, releasing hydrocarbon vapors into the atmosphere.

A membrane may be coupled to the underground storage tank between the vent and the underground storage tank. As pressure increases in the underground storage tank due to recovery of vapors and air from the fuel dispenser's vapor recovery system or vapor growth, the membrane system acts to capture the released vapors. The membrane separates the air from the hydrocarbons and returns the hydrocarbons back to the underground storage tank. The cleansed air is then released.

Membranes, however, are not one hundred percent efficient, and they do degrade over time until they fail. Thus, there remains a need to improve knowledge about the membrane operation to increase the likelihood that hydrocarbons are not released into the atmosphere. This allows for certainty as to compliance with emissions standards and may give a quantitative measurement as to how much vapor has been recovered and thus how much product the fuel environment has not lost without compensation.

SUMMARY OF THE INVENTION

The present invention associates a mass flow sensor with the vapor recovery membrane system of an underground fuel storage tank's vent. The mass flow sensor comprises a hydrocarbon sensor in conjunction with a vapor flow meter. Together the two sensors measure how much hydrocarbon vapor passes through the membrane. If the vapor rises above a predetermined threshold, an alarm may be generated. Alternatively, reporting of vapor levels passing through the mass flow sensor may be performed.

In an exemplary embodiment, two such mass flow sensors may be used. The first is positioned downstream of the membrane and the other upstream of the membrane. From these two measurements, an efficiency of the membrane may be determined, as well as the quantity of hydrocarbon vapor emitted to the atmosphere.

In a first alternate embodiment, a single mass flow sensor is positioned downstream of the vapor recovery membrane to ensure that the vapor recovery membrane is operating properly.

In a second alternate embodiment, a mass flow sensor is positioned between the vapor recovery membrane and the underground fuel storage tank to determine how much fuel vapor has been recovered. The fueling environment may be billed for this recovered vapor.

In a third alternate embodiment, the mass flow sensors report measurements to a remote location. The remote reporting may be to a site controller, a tank monitor that acts like a site controller, a remote computer connected to the fueling environment through a network, a governmental regulatory agency, or the like.

It should be appreciated that the embodiments are not mutually exclusive and may be combined as needed to arrive at permutations on the present invention uniquely suited for a particular fueling environment. Those skilled in the art will appreciate the scope of the present invention and realize additional aspects thereof after reading the following detailed description of the preferred embodiments in association with the accompanying drawing figures.

BRIEF DESCRIPTION OF THE DRAWINGS

The accompanying drawing figures incorporated in and forming a part of this specification illustrate several aspects of the invention, and together with the description serve to explain the principles of the invention.

DETAILED DESCRIPTION OF THE PREFERRED EMBODIMENTS

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Figure 1:
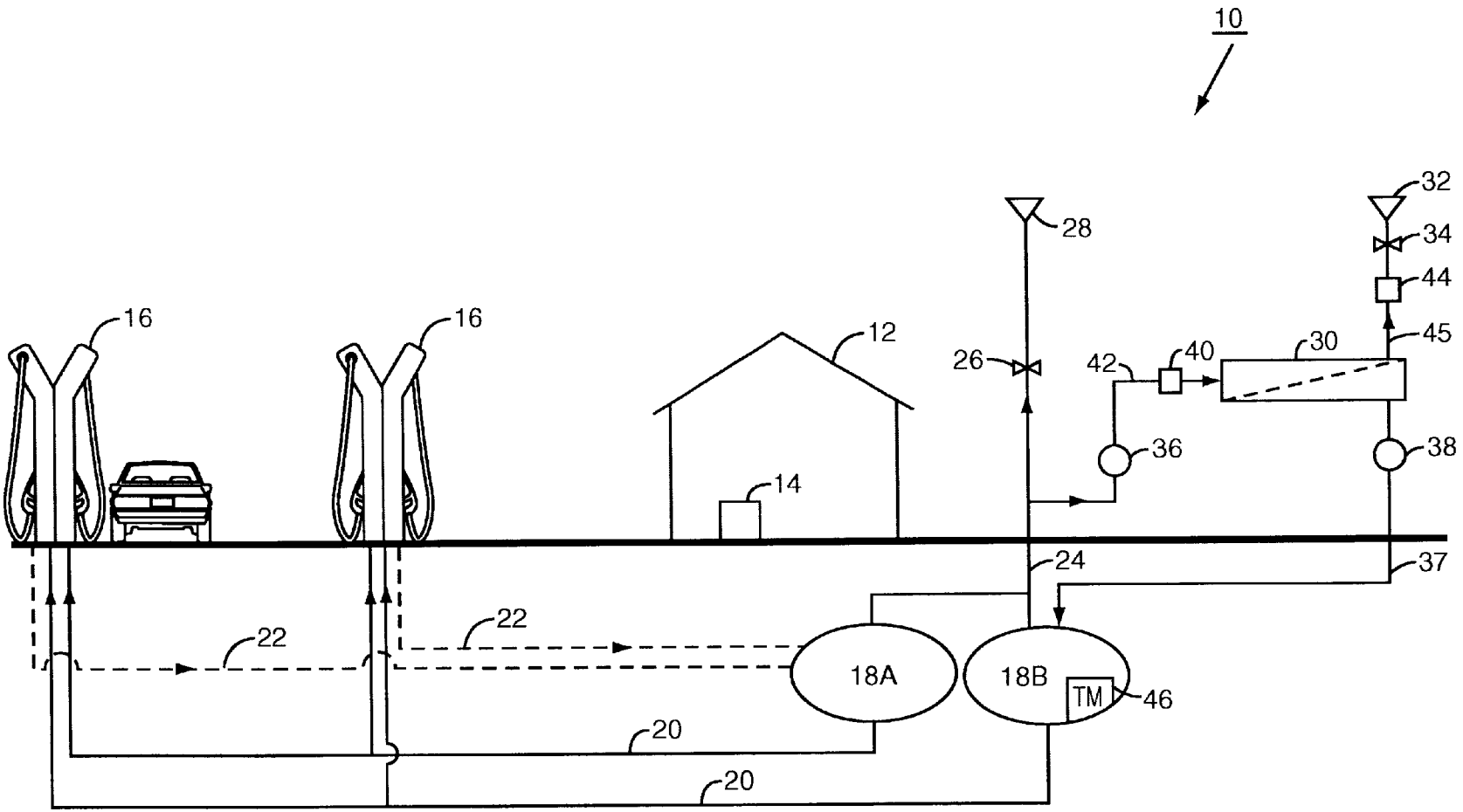
FIG. 1 illustrates a fueling environment with the fuel and vapor lines shown schematically.

FIG. 1 illustrates a fueling environment 10 with a building 12 containing a site controller 14 therein. Fuel dispensers 16 may be positioned proximate the building 12 as is conventional. It should be appreciated that the building 12 may be include a convenience store, a quick-serve restaurant, a service garage or the like. The site controller 14 may be a point of sale system and as such is not adapted for exposure to the environment, so some sort of protective structure is required. This protective structure need not be designed for human occupation and use, but typically is. The fuel dispensers 16 may be the ECLIPSE® or ENCORE® manufactured and sold by the assignee of the present invention, or other conventional fuel dispensers as needed or desired.

The fuel dispensers 16 receive fuel from one or more underground fuel storage tanks 18 via fuel delivery lines 20. In the embodiment shown, one underground fuel storage tank 18A comprises a high octane (93) fuel and the other underground fuel storage tank 18B comprises a regular octane (87) fuel. Intermediate octanes of fuel are created by blending the high and regular octane fuels as is well understood. Alternatively, a third underground fuel storage tank may be present with an intermediate grade of fuel.

The fuel dispensers 16 may be equipped with vapor recovery systems such as those disclosed in U.S. Pat. Nos. 5,040,577; 6,170,539; and U.S. Pat. No. Re. 35,238, and U.S. patent application Ser. No. 09/783,178 filed Feb. 14, 2001, all of which are hereby incorporated by reference in their entireties. Fuel vapor recovered by the vapor recovery systems is conveyed back to the underground fuel storage tanks 18 by vapor return lines 22 as is well understood.

As noted in the background, it is possible that the underground fuel storage tanks 18 are overpressurized by the vapor recovery systems or by ingesting air to compensate for a negative pressure. A vent line 24 is provided to help alleviate this problem. In conventional systems, the vent line 24 comprises a pressure relief valve 26 that allows gaseous components to be released to the atmosphere via a vent 28 when the pressure within the underground fuel storage tanks 18 exceeds an allowable threshold. Likewise, the pressure relief valve 26 may also allow atmospheric air into the underground fuel storage tanks 18 when a vacuum exceeding an allowable threshold is present within the underground fuel storage tanks 18.

When the pressure relief valve 26 opens to allow overpressurized gaseous components to be released, hydrocarbons are released into the atmosphere. This is sometimes known as a "fugitive emission." State and federal regulations limit the amount of acceptable fugitive emissions a fueling environment 10 may have. Thus, many fueling environments 10 benefit from the inclusion of a vapor recovery membrane 30 that helps reduce the amount of hydrocarbons released to the atmosphere. Air cleansed of hydrocarbons may then be released through a vent 32 controlled by a pressure relief valve 34. The original vent 28 may remain as an emergency pressure relief option.

The vent line 24 may split prior to the pressure relief valve 26 and direct gaseous components to the vapor recovery membrane 30 with the assistance of a pump 36. The vapor recovery membrane 30 may be one of two types: a) a membrane that permeates hydrocarbons and allows the now hydrocarbon-free air to be directed upward through the vent 32, or b) a membrane that permeates air and blocks hydrocarbons, allowing the now hydrocarbon free air to be directed upward through the vent 32. Examples of both types of membranes may be found in U.S. Pat. Nos. 5,464,466; 5,571,310; 5,611,841; 5,626,649; 5,755,854; 5,843,212; 5,985,002; and 6,293,996, all of which are hereby incorporated by reference in their entireties.

Hydrocarbons recovered by the vapor recovery membrane 30 may be returned to the underground fuel storage tanks 18 through the fuel vapor return line 37 with the assistance of a pump 38 as needed or desired.

The present invention further improves on this arrangement by associating a mass flow meter 40 with the membrane line 42. "Associating" as used herein comprises operatively connecting the mass flow meter 40 to the vapor line in question. In the embodiment shown, a first mass flow meter 40 is positioned upstream of the vapor recovery membrane 30 and a second mass flow meter 44 is positioned downstream of the vapor recovery membrane 30.

In an alternate embodiment, a single mass flow meter 44 is positioned downstream of the vapor recovery membrane 30. This may be in the fuel vapor return line 37 or the vent line 45.

The mass flow meters 40, 44 each comprise a vapor flow meter and a hydrocarbon sensor. A vapor flow meter is adapted to determine a flow rate of vapor that passes the meter, typically in terms of volumetric velocity such as $m^3$/sec. The hydrocarbon sensor determines how much hydrocarbon is present per unit of volume. This is effectively a concentration of hydrocarbons and may be expressed as a mass per unit of volume such as $g/m^3$ or $kg/m^3$. When the vapor flow rate is multiplied by the concentration of hydrocarbons, a total mass of hydrocarbons may be derived; i.e., HC concentration x vapor flow rate=mass amount of vapor The hydrocarbon sensor may sense an amount of hydrocarbons either directly or indirectly. An example of an indirect sensing is illustrated in U.S. Pat. No. 5,832,967, incorporated herein by reference, which measures oxygen levels and calculates a hydrocarbon level by subtracting the sensed oxygen levels from a predetermined value. The remainder is inferred to be hydrocarbons. Nitrogen sensors or the like may also be used for such indirect sensing. Direct sensors are illustrated in U.S. Pat. Nos. 5,782,275 and 6,338,369 and U.S. patent application Ser. Nos. 09/768,763, filed Jan. 23, 2001; the previously incorporated '178 application; and 09/602,476, filed Jun. 23, 2000, now U.S. Pat. No. 6,418,983, all of which are incorporated by reference herein in their entireties.

The vapor flow meter may comprise any conventional vapor flow meter, such as a positive displacement meter positioned within the vent line 45, or an inferential flow meter running in parallel with the vent line 45 as is well understood. For further information about vapor flow meters, reference is made to U.S. Pat. Nos. 4,688,418; 5,007,293; and 6,170,539, incorporated by reference herein in their entireties.

Because the vapor flow meter may not always be interposed directly within the vapor line, associating the mass flow meters 40, 44 with the vapor lines accomplishes the needed connections.

It is further possible that a mass flow meter may be associated with the vent 28. However, pressure relief valve 26 should only open under rare circumstances, such as when the vapor recovery membrane 30 cannot scrub the vapors from the vented gases fast enough, or failure of the pressure relief valve 34. In such circumstances, the pressure relief valve 26 acts as a redundant, emergency pressure relief valve. To monitor fugitive emissions for regulatory compliance, a mass flow meter may be associated with the vent 28.

A tank monitor 46 may be positioned in one or all of the underground fuel storage tanks 18. The tank monitor 46 may be similar to those sold by Veeder-Root, those embodied in U.S. Pat. Nos. 5,423,457; 5,400,253; 5,319,545; and 4,977,528, which are hereby incorporated by reference in their entireties, or other conventional tank monitors. The tank monitor 46 may monitor fuel levels, pressure levels, contaminant levels, and the like as needed or desired. While illustrated as being positioned within an underground fuel storage tank 18, the tank monitor 46 may be positioned outside the underground fuel storage tanks 18.

Figure 2:
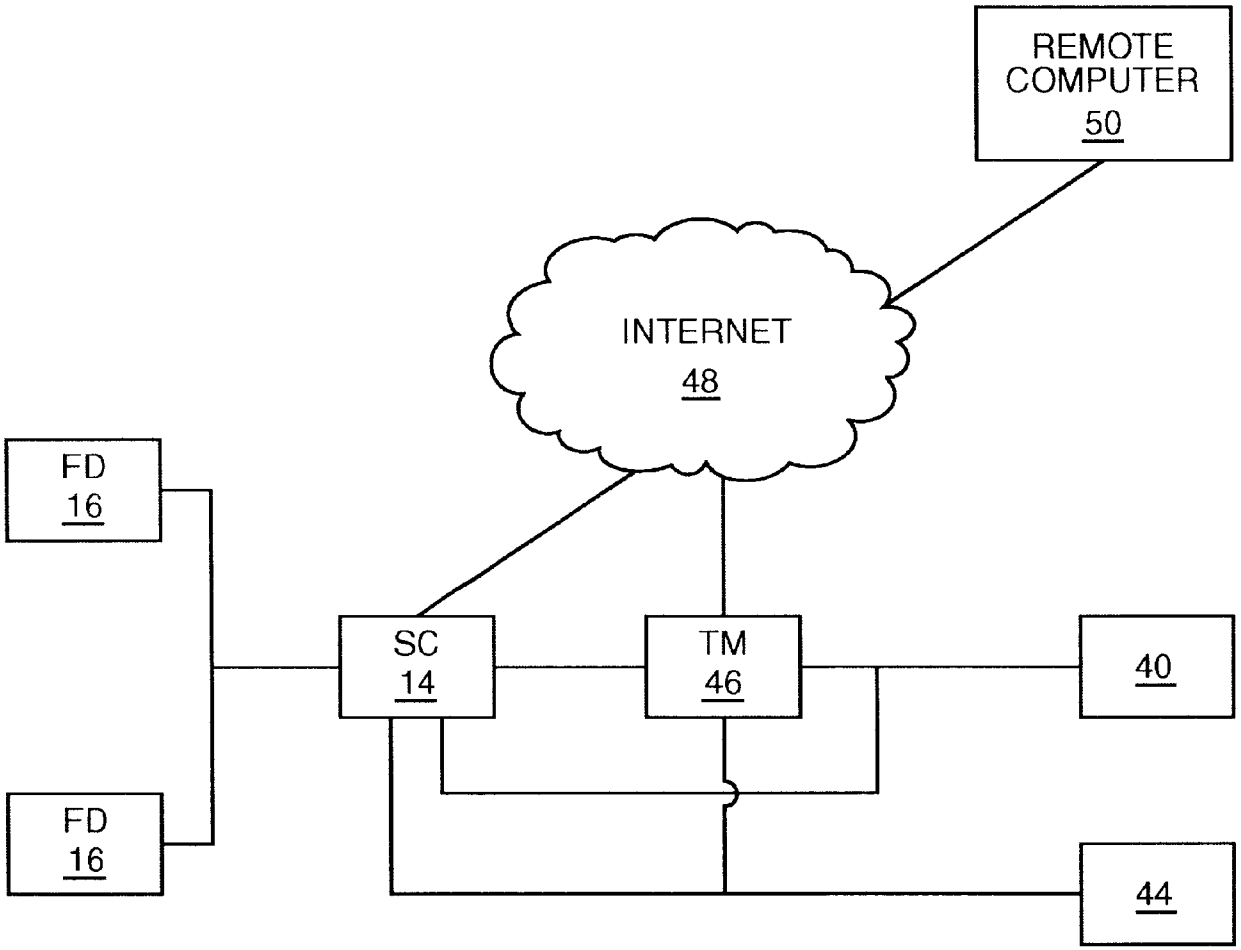
FIG. 2 illustrates a fueling environment with the communication lines shown schematically.

FIG. 2 is a schematic illustration of potential communicative links between the various elements of the fueling environment 10. As is conventional, the fuel dispensers 16 may communicate with the site controller 14. The site controller 14 may turn on and off the vapor recovery systems of the fuel dispensers 16, or this may be controlled by the fuel dispensers 16. The site controller 14 may also interface with the tank monitor 46 to receive inventory data about fuel sales, and may make comparisons to fuel sales in gallons to the fuel levels within the underground fuel storage tanks 18. The site controller 14 may further communicate through the internet 48 to a remote computer 50 to provide accounting functions, software upgrades, content provision, or the like for the fuel dispensers 16. While the internet 48 is contemplated, direct connections or other distributed computing networks connecting the site controller 14 to the remote computer 50 are also possible.

The mass flow meters 40, 44 may communicate with the site controller 14, the tank monitor 46, or both as needed or desired. The tank monitor 46 may communicate with the site controller 14 and the remote computer 50, such as through the internet 48.

The functionality of the present invention may lie in the site controller 14, the tank monitor 46, or some other controller (not shown) as needed or desired. A controller as used herein comprises a microprocessor coupled to memory or sequential logic circuit that is capable of receiving and processing outputs from the mass flow meters 40, 44. The outputs are reflective of measurements generated by the mass flow meters 40, 44 and may be used as such by the controller.

It is possible that an output may be generated by both the hydrocarbon sensor and the vapor flow meter within the mass flow meters 40, 44. In this case, the controller communicates with the mass flow meters 40, 44 using an appropriate protocol to extract the proper information as needed. The controller may then perform the multiplication of the two outputs to get the amount of hydrocarbons passing the mass flow meters 40, 44 at a given time.

The controller, be it the site controller 14, the tank monitor 46 or some other unit, receives the measurements from the mass flow meters 40, 44 and may use them in myriad ways. For example, if only the downstream mass flow meter 44 is present, the controller may verify that the air being released by the vent 32 is substantially free of hydrocarbons, or is at least in compliance with the relevant state and federal regulations regarding fugitive emissions. If both mass flow meters 40, 44 are present, their measurements may be compared by the controller to calculate an efficiency of the vapor recovery membrane 30. Likewise, the pumps 36, 38 may be controlled in part based on the outputs of the mass flow meters 40, 44. Still other uses may become readily apparent to those of ordinary skill in the art.

The controller may further communicate the data from the mass flow meters 40, 44 to the remote computer 50. This may be done so that the entity responsible for the remote computer 50 may compare the efficiency of the vapor recovery membrane 30 to others of its type, others of its age, others of differing ages, and the like to recommend service calls, warn the fueling environment 10 of failures, provide governmentally required reporting on emissions, or the like as needed or desired.

Still further, in one embodiment, the entity responsible for the installation of the vapor recovery membrane 30 may charge the fueling environment 10 for fuel vapors recovered and returned to the underground fuel storage tanks 18. By determining how much vapor was passing the upstream mass flow meter 40 and subtracting therefrom the amount of vapor passing the downstream mass flow meter 44, a quantity of fuel returned to the underground fuel storage tanks 18 may be determined. This represents fuel that may be recondensed and sold to consumers, so the fueling environment 10 may be willing to pay for this recovered fuel. The present arrangement allows for quantification such that such charges may be levied.

Figure 3:
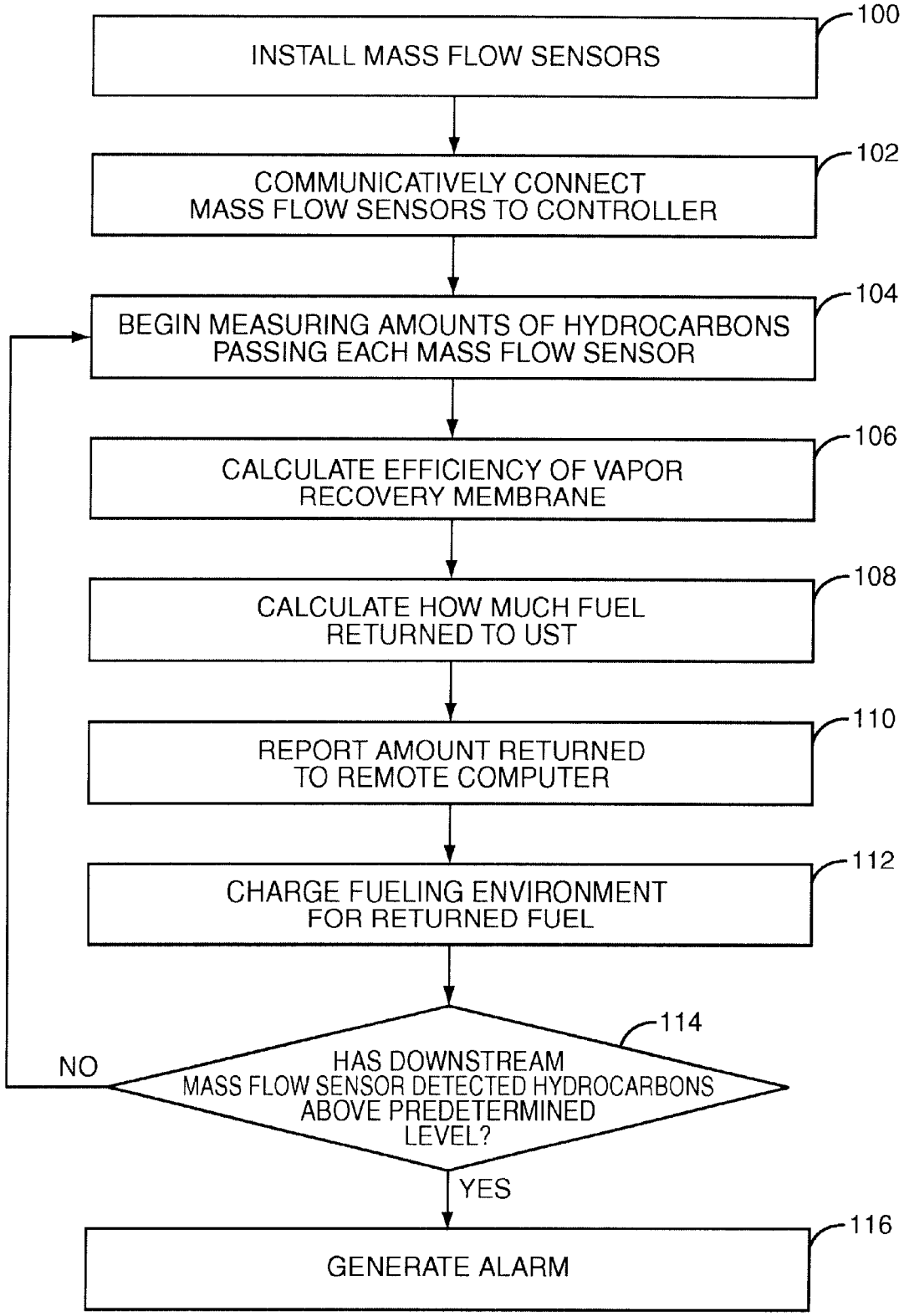
FIG. 3 illustrates a flow chart of one embodiment of the methodology of the present invention.

Some of the functionality of the present invention is better explicated with reference to FIG. 3. Initially, the mass flow sensors 40, 44 are installed (block 100). This may be done at the initial construction of the fueling environment 10 or subsequently as a retrofit. Further, while two mass flow sensors 40, 44 are preferred, it is possible to achieve some of the present functionality with only one mass flow sensor 40 or 44. In particular, a mass flow sensor 44 may monitor fugitive emissions and evaluate whether the vapor recovery membrane 30 is operating correctly. For some fueling environments 10, this may be sufficient. Thus, the mass flow sensors 40, 44 may be associated with the venting lines as follows: one upstream of the vapor recovery membrane 30, one downstream of the vapor recovery membrane 30 (either in vent line 45 or fuel vapor return line 37). An additional mass flow sensor may be associated with the vent 28.

The mass flow sensors 40, 44 are communicatively connected to the controller (block 102). As previously noted, the controller may be the site controller 14, the tank monitor 46, or other controller as needed or desired. The communicative link between the controller and the mass flow sensors 40, 44 may be through any appropriate topology and protocol. Wireless and wirebased LANs and the like are specifically contemplated with peer to peer or master-slave relationships as needed.

The mass flow sensors 40, 44 measure amounts of hydrocarbons passing through each mass flow sensor 40, 44 (block 104). This may begin prior to any vapor recovery; only after the first vapor recovery operation is begun; or other start time as needed or desired. As previously noted, the measurements by the mass flow sensors 40, 44 comprise a vapor flow rate measurement and a hydrocarbon amount sensor. The hydrocarbon amount sensor may be direct or indirect as previously noted. The flow rate multiplied by the hydrocarbon amount determines a mass of hydrocarbons that pass the mass flow sensors 40, 44.

By comparing the amount of hydrocarbons passing each mass flow sensor 40, 44, an efficiency of the vapor recovery membrane 30 may be calculated (block 106). While different techniques may be used to calculate efficiency, the simplest comprises subtracting the amount of hydrocarbons passing the downstream mass flow sensor 44 from the amount of hydrocarbons passing the upstream mass flow sensor 40, and dividing the difference by the amount of hydrocarbons passing the upstream mass flow sensor 40; i.e., $$\frac{output_{massflowsensor40} - output_{massflowsensor44}}{output_{massflowsensor40}} = \text{efficiency of vapor recovery membrane}$$

The controller may further calculate the amount of fuel vapor that has been returned to the underground fuel storage tanks 18 (block 108) by the fuel vapor return line 37. This may be done by subtracting the amount of hydrocarbons measured by the downstream mass flow sensor 44 from the amount of hydrocarbons measured by the upstream mass flow sensor 40. Alternatively, the downstream mass flow sensor 44 may be associated with the fuel vapor return line 37, rather than vent line 45.

The controller may then report to the remote computer 50 the amount of fuel vapor returned to the underground fuel storage tank 18*s* (block 110). This report may be sent directly, through the internet 48, or through a series of elements within the fueling environment 10 to the remote computer 50. For example, the mass flow sensors 40, 44 could report measurements to the tank monitor 46, and the tank monitor 46 could report the fuel returned to the underground fuel storage tanks 18 to the site controller 14, and the site controller 14 could report the amount to the remote computer 50. Variations on this theme are within the scope of the present invention. While it is contemplated that the remote computer 50 may be affiliated with some service entity that is responsible for the installation and care of the vapor recovery membrane 30, equivalently, the remote computer 50 could be controlled by a regulatory agency that monitors compliance with emission regulations.

The entity responsible for the remote computer 50 may then charge the fueling environment 10 for the fuel returned to the underground fuel storage tanks 18 (block 112). This may be economically justified because the fuel vapors returned may be recondensed and sold as fuel to a subsequent customer.

The controller may determine if the downstream mass flow sensor 44 has detected hydrocarbons above a predetermined level (block 114). The predetermined level may be set by state or federal emissions regulations, a desired emissions profile, or the like. If the answer to block 114 is "no", the predetermined threshold has not been exceeded, and the process repeats as needed. If the answer to block 114 is "yes", the predetermined threshold has been exceeded, and an alarm may be generated (block 116). This alarm may be audible, visual, sent by email, faxed, or otherwise conveyed as needed or desired. Further, the alarm may occur at the fueling environment 10 within the building 12 or at the remote computer 50 as needed or desired. This alarm may automatically generate a service call so that the vapor recovery membrane 30 may be replaced, or it may merely suggest such a course of action.

Note that the precise order of the flow chart of FIG. 3 may be rearranged, steps may be removed, or additional steps may be added without departing from the scope of the present invention. For example, the fueling environment 10 need not be charged for the fuel returned to the underground fuel storage tanks 18. Likewise, instead of reporting to a remote computer 50, the reports could be made to an operator within the building 12.

Those skilled in the art will recognize improvements and modifications to the preferred embodiments of the present invention. All such improvements and modifications are considered within the scope of the concepts disclosed herein and the claims that follow.

What is claimed is:

1. A method of controlling vapor emissions from an underground fuel storage tank, comprising:

associating a mass flow sensor with a vapor recovery membrane positioned in a vent associated with the underground fuel storage tank;

measuring hydrocarbon mass flowing through the vent with the mass flow sensor; and returning recovered fuel vapors from said vapor recover membrane to the underground fuel storage tank.

2. The method of claim 1, further comprising venting air to the atmosphere after the vapor recovery membrane has removed fuel vapors from the air.

3. The method of claim 1, further comprising determining a mass amount of hydrocarbons passing through the vapor recovery membrane based on the measuring.

4. The method of claim 1, further comprising generating an alarm if the mass of hydrocarbons passing through the vent exceeds a predetermined threshold.

5. The method of claim 1, further comprising associating a second mass flow sensor with the membrane.

6. The method of claim 5, wherein associating a second mass flow sensor with the membrane comprises positioning the second mass flow sensor upstream of the membrane.

7. The method of claim 6, wherein associating the mass flow sensor with the vapor recovery membrane comprises positioning the mass flow sensor downstream of the vapor recovery membrane.

8. The method of claim 7, further comprising calculating an efficiency of the vapor recovery membrane by comparing measurements from the two mass flow sensors.

9. The method of claim 1, wherein associating a mass flow sensor with a vent associated with the underground fuel storage tank comprises associating a hydrocarbon sensor and a vapor flow meter with the vent.

10. The method of claim 9, wherein associating a hydrocarbon sensor with the vent comprises associating a direct hydrocarbon sensor with the vent.

11. The method of claim 9, wherein associating a hydrocarbon sensor with the vent comprises associating an indirect hydrocarbon sensor with the vent.

12. The method of claim 11, wherein associating an indirect sensor with the vent comprises associating an oxygen sensor with the vent and inferring hydrocarbon content therefrom.

13. The method of claim 9, wherein associating a vapor flow meter with the vent comprises associating a positive displacement meter with the vent.

14. The method of claim 9, wherein associating a vapor flow meter with the vent comprises associating an inferential flow meter with the vent.

15. The method of claim 1, further comprising reselling recovered vapors to an entity associated with the underground fuel storage tank.

16. The method of claim 1, wherein measuring hydrocarbon mass flowing through the vent comprises multiplying a hydrocarbon vapor concentration by a vapor flow rate.

17. A vapor recovery system, comprising:

a vent adapted for use in releasing pressure in an underground storage tank to atmosphere;

a vapor recovery membrane associated with said vent;

a mass flow sensor associated with said vapor recovery membrane for measuring vapor passing through said vent; and a hydrocarbon return pipe for returning said vapor to the underground fuel storage tank.

18. The vapor recovery system of claim 17, further comprising a second mass flow sensor associated with an upstream side of said vapor recovery membrane.

19. The vapor recovery system of claim 17, further comprising a controller operatively connected to said mass flow sensor for determining an amount of vapor passing through the vent based on the measuring of said mass flow sensor.

20. The vapor recovery system of claim 19, wherein said controller is adapted to generate an alarm if the amount of vapor passing through the vent exceeds a predetermined threshold.

21. The vapor recovery system of claim 18, wherein said mass flow sensor is positioned downstream of the second mass flow sensor.

22. The vapor recovery system of claim 21, further comprising a controller, said controller determining an efficiency of said vapor recovery membrane by comparing measurements from said mass flow sensors.

23. The vapor recovery system of claim 17, wherein said mass flow sensor comprises a hydrocarbon sensor and a vapor flow meter.

24. The vapor recovery system of claim 23, wherein said hydrocarbon sensor comprises an indirect hydrocarbon sensor.

25. The vapor recovery system of claim 23, wherein said hydrocarbon sensor comprises a direct hydrocarbon sensor.

26. The vapor recovery system of claim 23, wherein said vapor flow meter comprises a positive displacement meter.

27. The vapor recovery system of claim 23, wherein said vapor flow meter comprises an inferential flow meter.

28. A fueling environment, comprising:

a fuel dispenser;

a fuel storage tank fluidly connected to said fuel dispenser;

a vent operatively connected to said fuel storage tank;

a vapor recovery membrane associated with said vent;

a first mass flow meter positioned downstream of said vapor recovery membrane in said vent;

a controller for determining an amount of hydrocarbons passing through said vent based on a first output from said first mass flow meter; and a vapor return element for returning hydrocarbons recovered by said vapor recovery membrane to the fuel storage tank.

29. The fueling environment of claim 28, further comprising a second mass flow meter positioned upstream of said vapor recovery membrane in said vent and providing a second output to said controller.

30. The fueling environment of claim 29, wherein said controller determines an efficiency of said vapor recovery membrane based on said first and second outputs.

31. The fueling environment of claim 28, wherein said controller is adapted to communicate with a remote location.

32. The fueling environment of claim 31, wherein said controller reports to a government entity when communicating with the remote location.

33. The fueling environment of claim 31, wherein said controller provides data from said mass flow meter to the remote location.

34. A method of controlling vapor emissions from an underground fuel storage tank, comprising:

associating a mass flow sensor with a vapor recovery membrane positioned in a vent associated with an underground fuel storage tank;

measuring hydrocarbon mass flowing through the vent with the mass flow sensor; and reselling recovered vapors to an entity associated with the underground fuel storage tank.

35. A method of controlling vapor emissions from an underground fuel storage tank, comprising:

associating a mass flow sensor with a vapor recovery membrane positioned in a vent associated with the underground fuel storage tank;

measuring hydrocarbon mass flowing through the vent with the mass flow sensor; and associating a second mass flow sensor with the membrane.

36. The method of claim 35, wherein associating a second mass flow sensor with the membrane comprises positioning the second mass flow sensor upstream of the membrane.

37. The method of claim 36, wherein associating the mass flow sensor with the vapor recovery membrane comprises positioning the mass flow sensor downstream of the vapor recovery membrane.

38. The method of claim 37, further comprising calculating an efficiency of the vapor recovery membrane by comparing measurements from the two mass flow sensors.

39. A vapor recovery system, comprising:

a vent adapted for use in releasing pressure in an underground storage tank to atmosphere;

a vapor recovery membrane associated with said vent; and a mass flow sensor associated with said vapor recovery membrane for measuring vapor passing through said vent;

said mass flow sensor comprises a hydrocarbon sensor and an inferential vapor flow meter.

40. A vapor recovery system, comprising:

a vent adapted for use in releasing pressure in an underground storage tank to atmosphere;

a vapor recovery membrane associated with said vent; and a mass flow sensor associated with said vapor recovery membrane for measuring vapor passing through said vent; and a second mass flow sensor associated with said vapor recovery membrane.

41. The method of claim 40, wherein associating a second mass flow sensor with the membrane comprises positioning the second mass flow sensor upstream of the membrane.

42. The method of claim 41, wherein associating the mass flow sensor with the vapor recovery membrane comprises positioning the mass flow sensor downstream of the vapor recovery membrane.

43. The method of claim 42, further comprising calculating an efficiency of the vapor recovery membrane by comparing measurements from the two mass flow sensors.

44. A fueling environment, comprising:

a fuel dispenser;

a fuel storage tank fluidly connected to said fuel, dispenser;

a vent operatively connected to said fuel storage tank;

a vapor recovery membrane associated with said vent;

a first mass flow meter positioned downstream of said vapor recovery membrane in said vent;

a controller for determining an amount of hydrocarbons passing through said vent based on a first output from said first mass flow meter; and a second mass flow meter positioned upstream of said vapor recovery membrane in said vent and providing a second output to said controller.

45. The fueling environment claim 44, where said controller determines an efficiency of said vapor recovery membrane based on said first and second outputs.

* * * * *